US009141054B2

(12) United States Patent
Sawamura et al.

(10) Patent No.: US 9,141,054 B2
(45) Date of Patent: Sep. 22, 2015

(54) FIXING DEVICE, AND IMAGE FORMING APPARATUS

(71) Applicant: FUJI XEROX CO., LTD., Minato-ku, Tokyo (JP)

(72) Inventors: Jun Sawamura, Kanagawa (JP); Hideki Sato, Kanagawa (JP); Yasuhiro Kato, Kanagawa (JP); Kensuke Ainai, Kanagawa (JP); Shigeyuki Maruhashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/258,513

(22) Filed: Apr. 22, 2014

(65) Prior Publication Data

US 2015/0098735 A1 Apr. 9, 2015

(30) Foreign Application Priority Data

Oct. 7, 2013 (JP) ..... 2013-210522

(51) Int. Cl.
*G03G 15/20* (2006.01)

(52) U.S. Cl.
CPC ..... *G03G 15/2067* (2013.01)

(58) Field of Classification Search
CPC ..... G03G 15/2053; G03G 15/2017; G03G 15/2064; G03G 15/206
USPC ..... 399/329
See application file for complete search history.

(56) References Cited

U.S. PATENT DOCUMENTS

2008/0292374 A1* 11/2008 Hiraoka et al. ..... 399/328
2008/0310895 A1 12/2008 Masuda et al.
2012/0251206 A1* 10/2012 Nakamura et al. ..... 399/329
2013/0121738 A1 5/2013 Masuda et al.
2013/0223864 A1* 8/2013 Ishido ..... 399/67
2013/0302073 A1* 11/2013 Takeuchi ..... 399/328

FOREIGN PATENT DOCUMENTS

JP 2008-176087 A 7/2008

* cited by examiner

*Primary Examiner* — Walter L Lindsay, Jr
*Assistant Examiner* — Frederick Wenderoth
(74) *Attorney, Agent, or Firm* — Sughrue Mion, PLLC

(57) ABSTRACT

Provided is a fixing device including a fixing member that fixes toner to a recording material, a pressurizing member that forms a nip portion through which the recording material passes between the fixing member and the pressurizing member, a contacting and separating mechanism that contacts and separates the pressurizing member with and from the fixing member, and a pressure adjusting mechanism that is provided capable of advancing to and retreating from a region that moves along with contacting and separating of the pressurizing member with and from the fixing member by the contacting and separating mechanism while moving along a straight line direction, and adjusts a pressure in the nip portion by contacting the contacting and separating mechanism in the region.

9 Claims, 16 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2013-210522 filed Oct. 7, 2013.

BACKGROUND

Technical Field

The present invention relates to a fixing device, and an image forming apparatus.

SUMMARY

According to an aspect of the invention, there is provided a fixing device including:

a fixing member that fixes toner to a recording material;

a pressurizing member that forms a nip portion through which the recording material passes between the fixing member and the pressurizing member;

a contacting and separating mechanism that contacts and separates the pressurizing member with and from the fixing member; and a pressure adjusting mechanism that is provided capable of advancing to and retreating from a region that moves along with contacting and separating of the pressurizing member with and from the fixing member by the contacting and separating mechanism while moving along a straight line direction, and adjusts a pressure in the nip portion by contacting the contacting and separating mechanism in the region.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention is described in detail with reference to the annexed drawings.

Image Forming Apparatus 1

Figure 1:
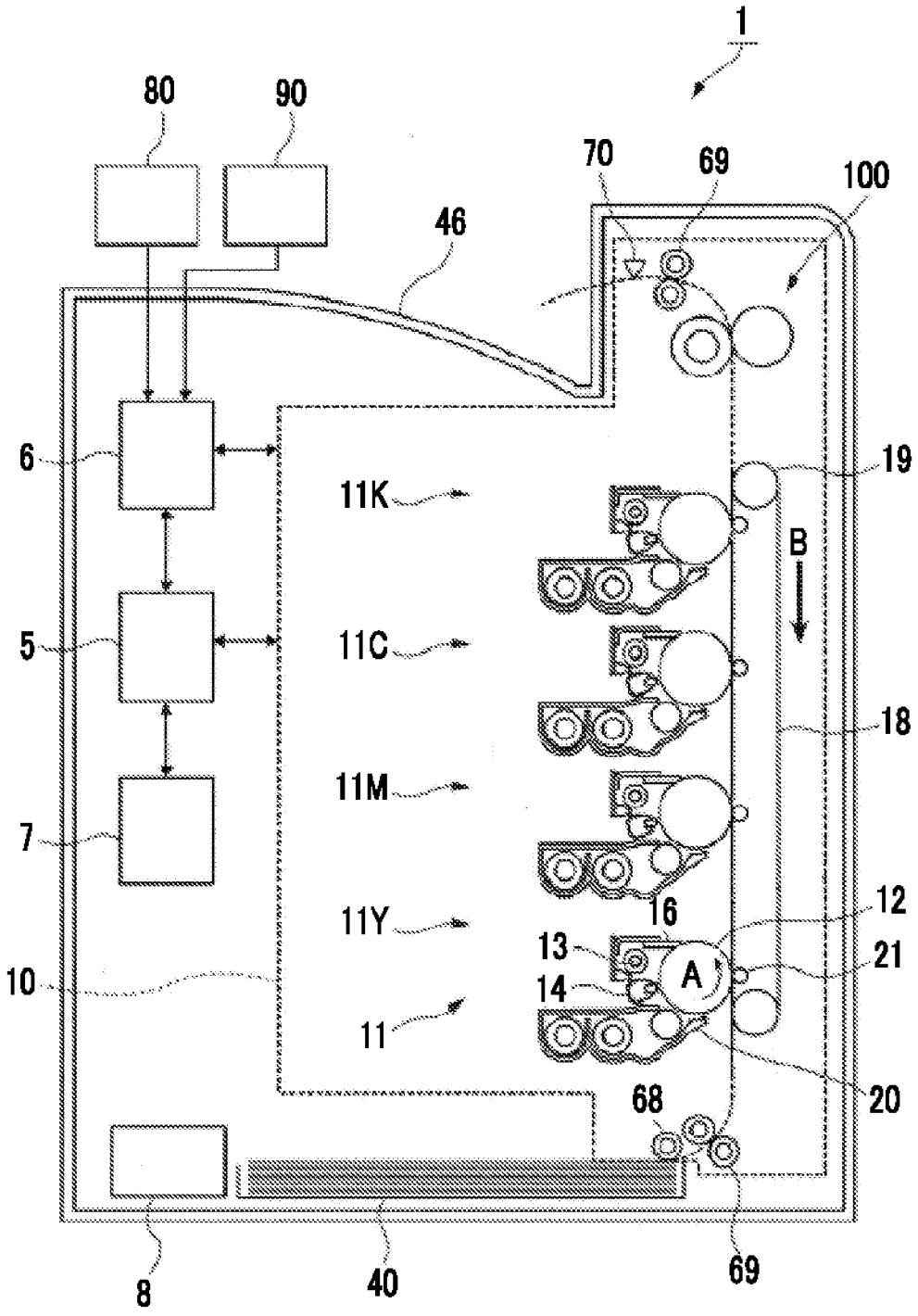
FIG. 1 is a schematic configuration diagram illustrating an image forming apparatus to which an exemplary embodiment is applied.

FIG. 1 is a schematic configuration diagram illustrating an image forming apparatus 1 to which the exemplary embodiment is applied.

The image forming apparatus 1 illustrated in FIG. 1 is a so-called tandem type color printer. The image forming apparatus 1 includes an image forming portion 10 for forming an image corresponding to image data of each color. Further, the image forming apparatus 1 includes a control portion 5 that controls an operation of an entirety of the image forming apparatus 1, an image processing portion 6 that is connected to, for example, an external device such as a personal computer (PC) 80 or an image reader 90, and performs predetermined image processing with respect to the image data received from the external device, and a user interface 7 that receives instruction given by an operation of a user. Further, the image forming apparatus 1 includes a power supply portion 8 that supplies power to each portion. Furthermore, the image forming apparatus 1 includes a sheet stacking section 40 that stacks a sheet (recording material) supplied to the image forming portion 10, and a discharged sheet stacking section 46 that stacks the sheet on which the image is formed by the image forming portion 10.

Image Forming Portion 10

The image forming portion 10 includes four image forming units 11 (particularly, 11Y, 11M, 11C and 11K) placed in parallel having predetermined gaps. Further, the image forming portion 10 includes a transportation belt 18 that transports a sheet for multiply transferring a toner image of each color formed by each image forming unit 11, a driving roller 19 that rotates the transportation belt 18, a transfer roller 21 that transfers the toner image of each color formed by each image forming unit 11 on the sheet, and a fixing device 100 that fixes the toner image of each color that is transferred to the sheet.

Further, the image forming portion 10 includes a pickup roller 68 that sequentially feeds the sheet that is stacked on the sheet stacking section 40, and a transportation roller 69 that transports the sheet fed by the pickup roller 68. Furthermore, the image forming portion 10 includes an exit sensor 70 that detects passing of the sheet to which the toner image is fixed in the fixing device 100.

The image forming unit 11 includes a photoconductor drum 12 that holds the toner image by forming an electrostatic latent image, a charging unit 13 that uniformly charges a surface of the photoconductor drum 12 with a predetermined potential, an LED print head (LPH) 14 that exposes the photoconductor drum 12 charged by the charging unit 13 based on image data, a developing device 20 that develops the electrostatic latent image formed on the photoconductor drum 12 by using developer, and a cleaner 16 that cleans the surface of the photoconductor drum 12 after the transfer. Moreover, image forming units 11Y, 11M, 11C and 11K are configured substantially similar to each other except for the toner stored in the developing device 20. Further, the image forming units 11Y, 11M, 11C and 11K form toner images of yellow (Y), magenta (M), cyan (C) and black (K), respectively.

Operation of Image Forming Apparatus 1

In the image forming apparatus 1 of the exemplary embodiment, the image data input from the PC 80 or the image reader 90 are transmitted to each image forming unit 11 through an interface (not illustrated) after predetermined image processing is performed by the image processing portion 6. Then, for example, in the image forming unit 11K that forms the toner image of black (K), the photoconductor drum 12 is uniformly charged with a predetermined potential by the charging unit 13 while rotating in an arrow A direction, and scanning exposure is performed by the LPH 14 based on the image data transmitted from the image processing portion 6. Therefore, the electrostatic latent image regarding the image of black (K) is formed on the photoconductor drum 12. Then, the electrostatic latent image formed on the photoconductor drum 12 is developed by the developing device 20 and the toner image of black (K) is formed on the photoconductor drum 12. Similarly, also in the image forming units 11Y, 11M and 11C, the toner images of each color of yellow (Y), magenta (M) and cyan (C) are formed, respectively.

Meanwhile, the sheet stacked on the sheet stacking section 40 is fed by the pickup roller 68. Then, the sheet fed by the pickup roller 68 is transported by the transportation belt 18 moving in an arrow B direction and then the toner image of each color formed by each image forming unit 11 is superposed. Then, the sheet on which the superposed toner image is electrostatically transferred is separated from the transportation belt 18 and is transported to the fixing device 100. The toner image on the sheet is subjected to fixing processing by heat and a pressure by the fixing device 100, and is fixed on the sheet. Then, the sheet on which the fixed image is formed is further transported by the transportation roller 69 and is stacked on the discharged sheet stacking section 46 after being detected by the exit sensor 70.

Configuration of Fixing Device 100

Figure 2:
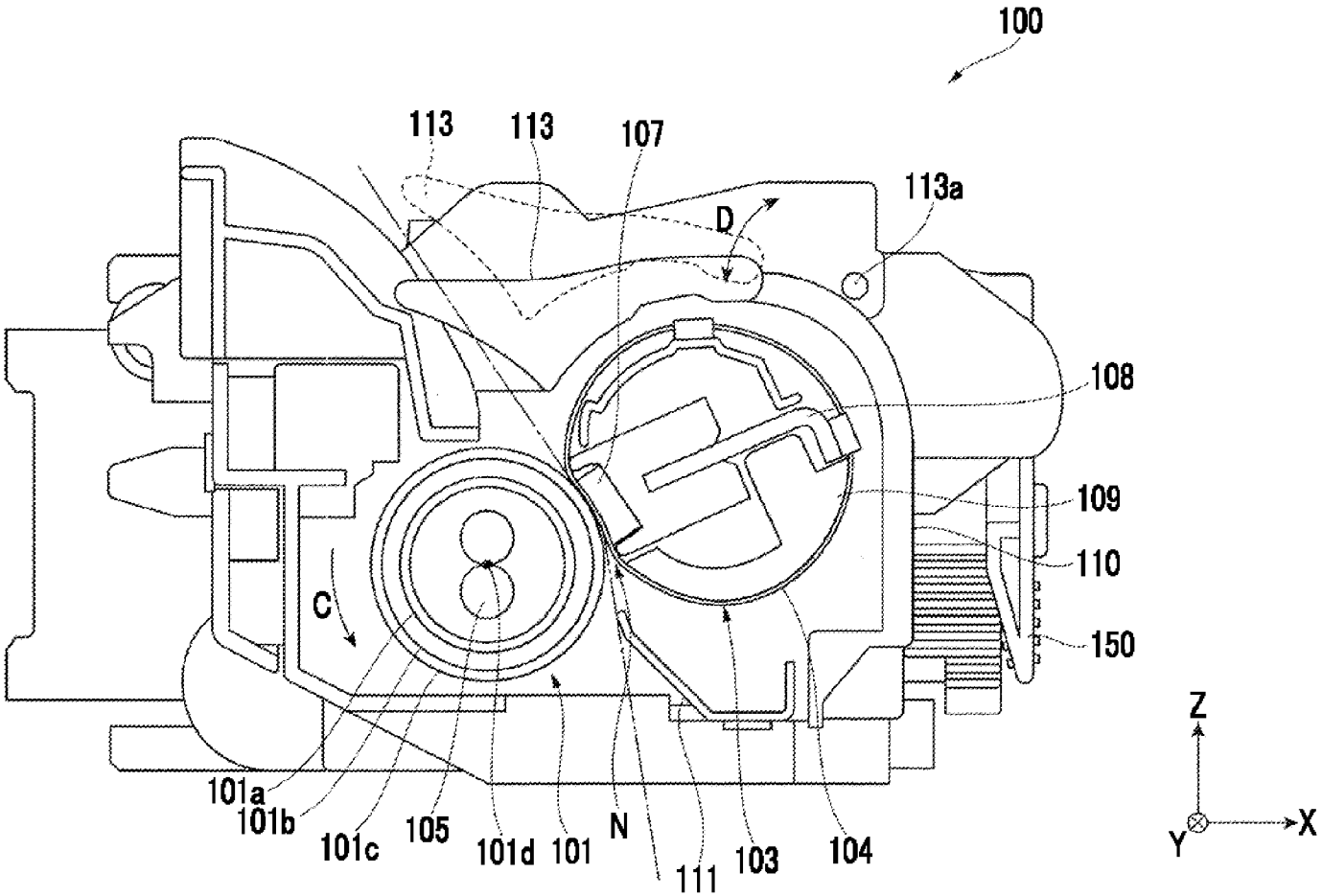
FIG. 2 is a schematic configuration diagram of a fixing device to which the exemplary embodiment of the invention is applied.
Figure 3A:
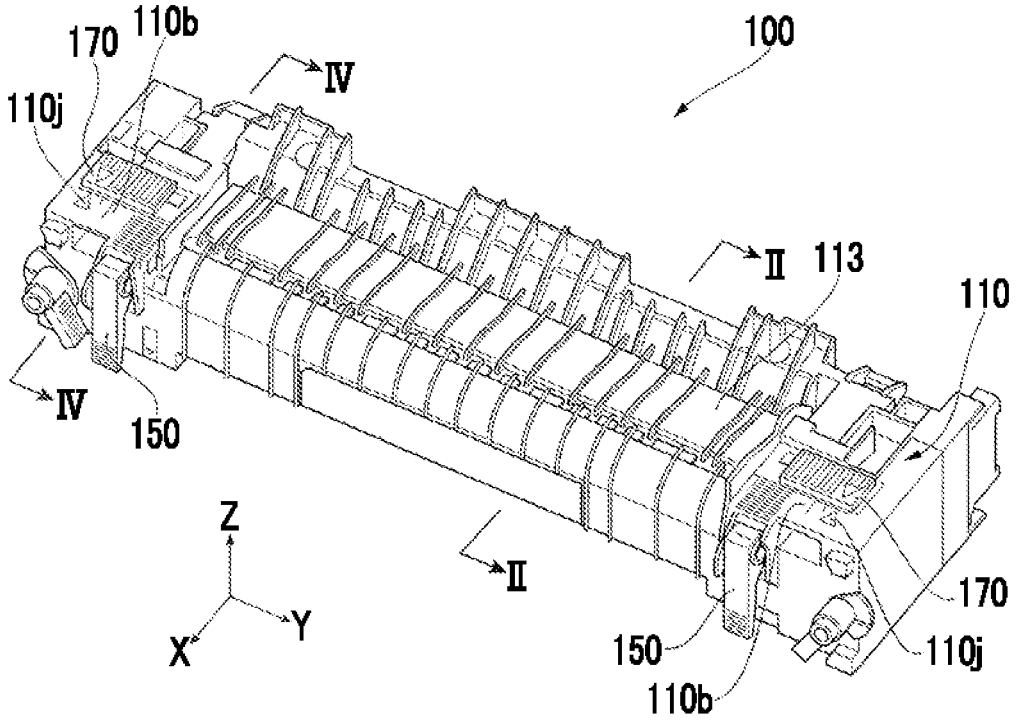
FIG. 3A is a perspective view of the fixing device to which the exemplary embodiment of the invention is applied and FIG. 3B is a schematic configuration diagram of a switch support portion to which the exemplary embodiment of the invention is applied.
Figure 3B:
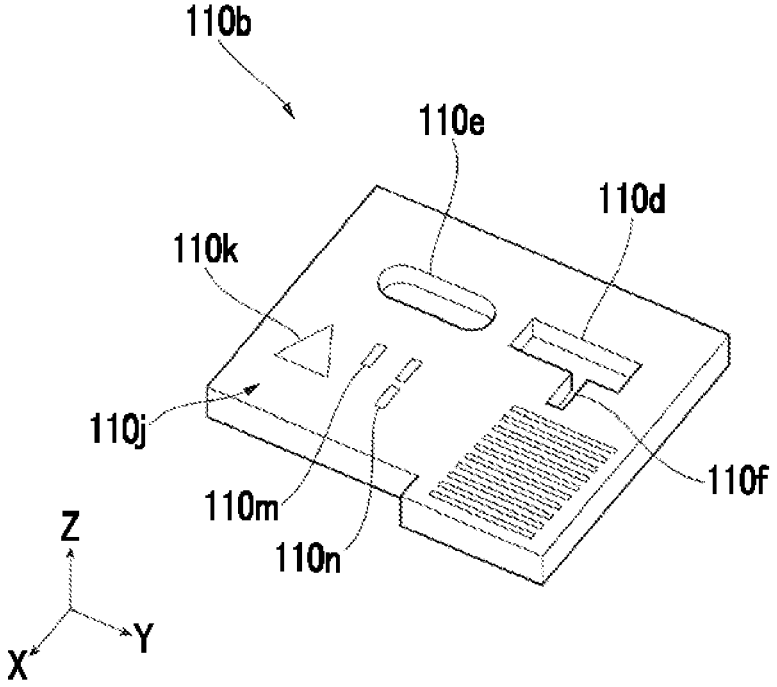
Figure 4:
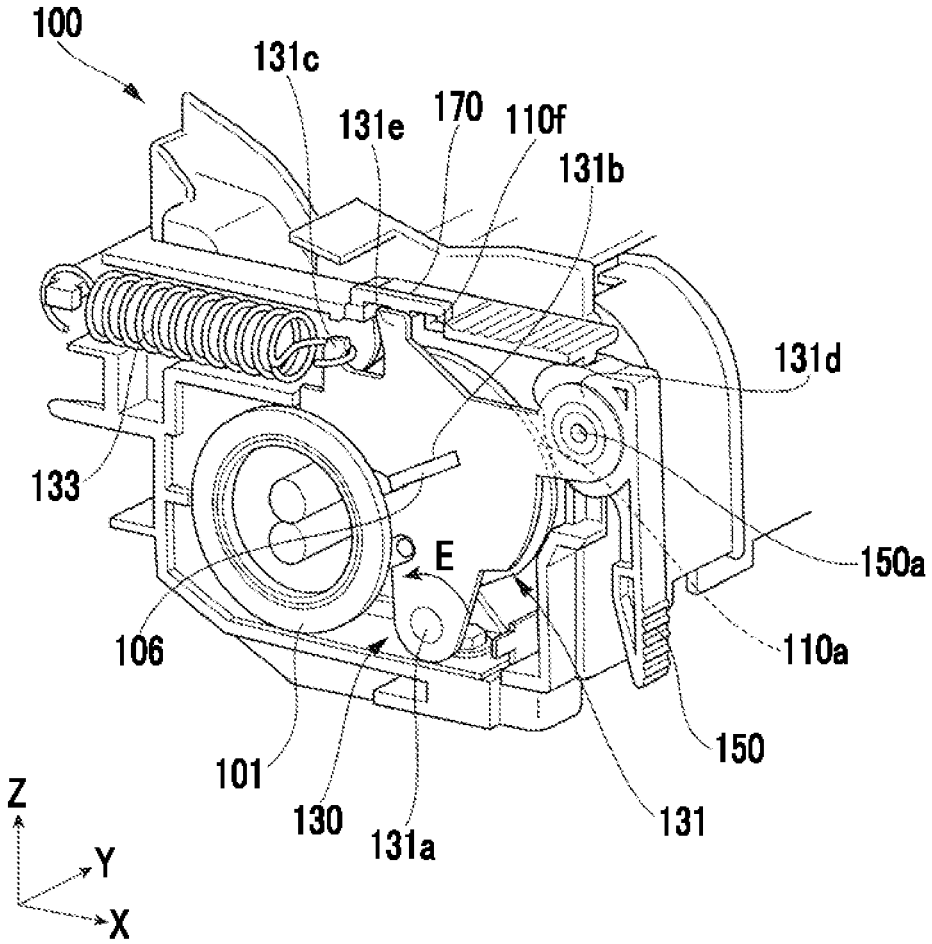
FIG. 4 is a schematic configuration diagram of the vicinity of an urging portion of the fixing device to which the exemplary embodiment of the invention is applied.

FIG. 2 is a schematic configuration diagram of the fixing device 100 to which the exemplary embodiment of the invention is applied. Further, FIG. 3A is a perspective view of the fixing device 100 to which the exemplary embodiment of the invention is applied and FIG. 3B is a schematic configuration diagram of a switch support portion 110*b* to which the exemplary embodiment of the invention is applied. Further, FIG. 4 is a schematic configuration diagram of the vicinity of an urging portion 130 of the fixing device 100 to which the exemplary embodiment of the invention is applied. Moreover, FIG. 2 illustrates a schematic configuration diagram in cross section II of FIG. 3A and FIG. 4 illustrates a schematic configuration diagram in cross section IV of FIG. 3A.

As illustrated in FIG. 2, the fixing device 100 of the exemplary embodiment includes a fixing roller 101 that fixes the toner image formed on the sheet, a pressurizing belt 103 that is placed so as to face the fixing roller 101, a housing 110 in which each functional member is provided, the urging portion 130 (see FIG. 4) that urges the pressurizing belt 103 against the fixing roller 101 and forms a nip portion N, a release lever 150 that is capable of releasing a contact pressure (nip pressure) of the nip portion N, and a slide switch 170 (see FIG. 3A) that is capable of adjusting the nip pressure of the nip portion N.

Moreover, the fixing device 100 in the illustrated example includes a fixing inlet port guide 111 that guides the sheet to the nip portion N on an upstream side from the nip portion N in a transportation direction of the sheet, and a fixing outlet port guide 113 that guides the sheet that is transported from the nip portion N to the transportation roller 69 (see FIG. 1) on a downstream side from the nip portion N in the transportation direction of the sheet. Additionally, in the illustrated example, the fixing outlet port guide 113 is rotatably (see an arrow D) provided about a rotating shaft 113*a*.

In the following description, a depth direction (a direction along an axial direction of the fixing roller 101) of FIG. 2 is referred to as a Y direction, a horizontal direction (a left and right direction in the view) orthogonal to the Y direction is referred to as an X direction, and a vertical direction (an up and down direction in the view) orthogonal to the X direction and the Y direction is referred to as a Z direction. Further, in FIG. 2, a direction toward the right side in the X direction is referred to as a +X direction, a direction toward the depth side of a paper surface in the Y direction is referred to as a +Y direction, and a direction toward the upper side of the paper surface in the Z direction is referred to as a +Z direction.

Fixing Roller 101

As illustrated in FIG. 2, the fixing roller 101 that is an example of the fixing member is a cylindrical roller configured by laminating a heat-resistant elastomer layer 101*b*, for example, formed of rubber and a release layer 101*c*, for example, formed of fluorine rubber or the like around a cylindrical core 101*a* made of a metal formed of, for example, aluminum. The cylindrical roller rotates about a rotating shaft 101*d*.

Further, the fixing roller 101 includes a halogen lamp 105 as a heat source, and a temperature sensor (not illustrated) that is provided by coming into contact with an outer circumferential surface of the release layer 101*c* on the inside thereof. Furthermore, the fixing roller 101 is provided by connecting to a drive motor (not illustrated).

Pressurizing Belt 103

As illustrated in FIG. 2, the pressurizing belt 103 that is an example of the pressurizing member includes a pressurizing belt body 104, a pressing pad 107 that is placed inside the pressurizing belt body 104, a pad holder 108 that holds the pressing pad 107 inside the pressurizing belt body 104, and a belt guide member 109 that supports the pressurizing belt body 104 from the inside thereof.

The pressurizing belt body 104 is formed by a seamless endless belt of which an original form is cylindrically formed so as not to cause defects caused by seams in the image that is formed. For example, the pressurizing belt body 104 is configured of a single layer that is formed by mixing a fluorine resin and reinforcing filler.

For example, the pressing pad 107 is formed of an elastomer such as silicone rubber or fluorine rubber. The pressing pad 107 includes a low friction sheet (not illustrated) on a surface in contact with the pressurizing belt body 104 to reduce sliding resistance between the inner circumferential surface of the pressurizing belt body 104 and the pressing pad 107.

For example, the pad holder 108 is formed of a planar member made of metal. The pad holder 108 holds the pressing pad 107 in a position where the pressing pad 107 faces the fixing roller 101 through the pressurizing belt body 104 on the inside of the pressurizing belt body 104.

For example, the belt guide member 109 is formed of a resin material and rotatably supports the pressurizing belt body 104 from the inside of the pressurizing belt body 104.

Then, as described below, the pressurizing belt 103 is placed so that the pressurizing belt body 104 is in pressure contact with the fixing roller 101 through the urging portion 130. When the pressurizing belt body 104 is in pressure contact with the fixing roller 101, the pressing pad 107 of the pressurizing belt body 104 is pressed to the fixing roller 101 through the pressurizing belt body 104.

Operation of Fixing Roller 101 and Pressurizing Belt 103

In such a configuration, the fixing roller 101 is rotated (see an arrow C) by receiving driving of the drive motor (not illustrated) and the pressurizing belt 103 also rotates following the rotation thereof. The sheet onto which the toner image is electrostatically transferred by the image forming portion 10 (see FIG. 1) is transported to the nip portion N while being guided by the fixing inlet port guide 111. Then, the toner image on the sheet is fixed to the sheet by the pressure operating on the nip portion N and heat supplied from the fixing roller 101 when the sheet passes through the nip portion N. Then, the sheet onto which the image is fixed is transported to the transportation roller 69 while pushing up the fixing outlet port guide 113 (see the fixing outlet port guide 113 illustrated by a dashed line in the view).

Housing 110

As illustrated in FIG. 3A, the housing 110 is configured of a substantially oblong member of which a longitudinal direction is along the Y direction. A functional member such as the fixing roller 101 or the pressurizing belt 103 described above is placed on the inside of the housing 110. Moreover, the urging portion 130 (see FIG. 4) is provided on the inside of each of both end sides of the housing 110 in the Y direction.

Moreover, the release lever 150 and the slide switch 170 are provided outside of each of both end sides of the housing 110 in the Y direction.

Here, the housing 110 includes the switch support portions 110*b* which are on the outer circumferential surface toward the +Z direction and support the slide switches 170 on both of the end sides of the housing 110 in the Y direction. As illustrated in FIG. 3B, a scale mark 110*j* formed of a scale illustrating the position of the slide switch 170 is formed in the switch support portion 110*b*. Particularly, the scale mark 110*j* includes a first scale 110*k*, a second scale 110*m*, and a third scale 110*n* in this order toward the +Y direction.

Further, the switch support portion 110*b* is provided with a receiving portion through hole 110*d* that is a long hole of which a longitudinal direction is provided along the Y direction, a fixing portion through hole 110*e* that is a long hole which is provided in the −Y direction from the receiving portion through hole 110*d* and of which a longitudinal direction is provided along the Y direction, and a protrusion through hole 110*f* that is a long hole of which a longitudinal direction is provided along the X direction. Here, the protrusion through hole 110*f* is continuously provided with the receiving portion through hole 110*d* in the center portion of the receiving portion through hole 110*d* in the Y direction.

Urging Portion 130

As illustrated in FIG. 4, the urging portion 130 is provided in each end portion of the pressurizing belt 103 in the Y direction. In the illustrated example, the urging portion 130 holds a claw portion 106 that is a part of the pressurizing belt 103 and provided in the end portion of the pressurizing belt 103.

The urging portion 130 includes a lever nip 131 that holds the pressurizing belt 103 and is provided to be capable of advancing to and retreating from the fixing roller 101, and a spring 133 that urges the lever nip 131.

For example, the lever nip 131 that is an example of an contacting and separating mechanism is a planar member made of a metal. The lever nip 131 includes a rotating shaft 131*a*, a holder groove 131*b* into which the claw portion 106 of the pressurizing belt 103 is inserted, a spring protrusion 131*c* that is a protrusion on which one end of the spring 133 is hung, a release lever hole 131*d* that rotatably supports a rotating shaft 150*a* (described below) of the release lever 150, and a slide switch protrusion 131*e* to which the slide switch 170 is hooked.

Here, the spring protrusion 131*c* of the lever nip 131 is urged in the −X direction by receiving an elastic force of the spring 133. The urged lever nip 131 rotates (see an arrow E) about the rotating shaft 131*a* and presses the claw portion 106 of the pressurizing belt 103 inserted into the holder groove 131*b* toward the side of the fixing roller 101. Therefore, the urging portion 130 presses the pressurizing belt 103 to the fixing roller 101.

Release Lever 150

Figure 5A:
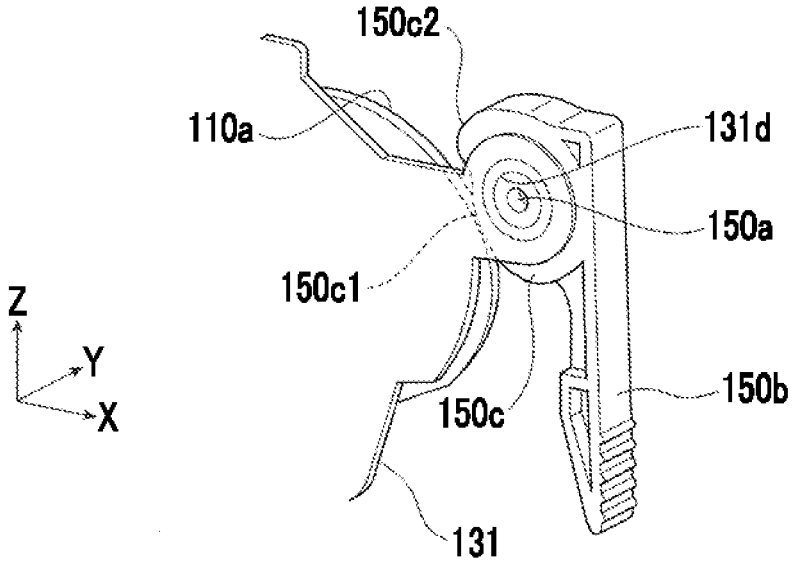
FIG. 5A is a schematic configuration diagram illustrating a release lever and FIG. 5B is a view illustrating placement of the release lever.
Figure 5B:
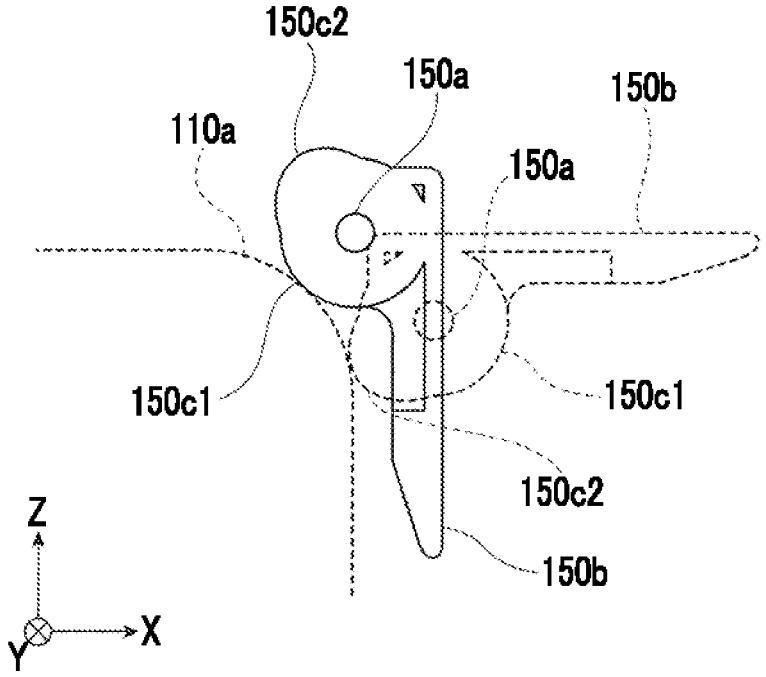
Figure 6:
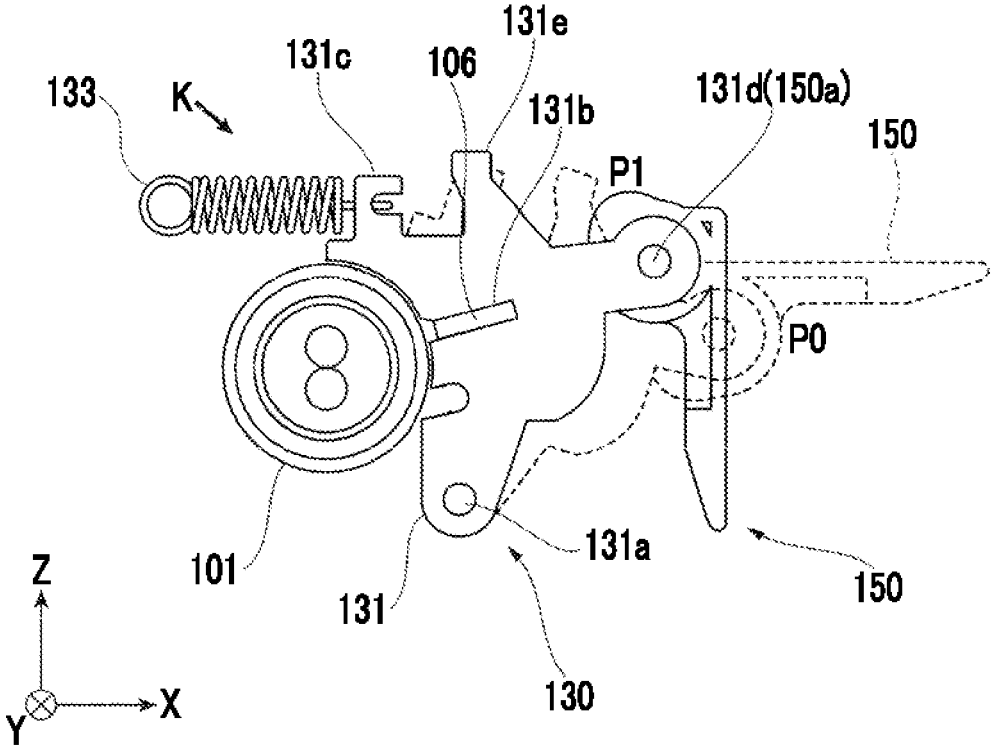
FIG. 6 is a view illustrating an operation of the release lever.

FIG. 5A illustrates a schematic configuration diagram of the release lever 150 and FIG. 5B is a view illustrating a placement of the release lever 150. FIG. 6 is a view illustrating an operation of the release lever 150.

As illustrated in FIG. 5A, the release lever 150 that is an example of a release mechanism includes the rotating shaft 150*a*, a release lever body 150*b* that is rotatably provided about the rotating shaft 150*a*, and a cam 150*c* that is provided around the rotating shaft 150*a*. Moreover, the cam 150*c* includes a base circle 150*c*1 and a cam lobe 150*c*2.

Here, the rotating shaft 150*a* of the release lever 150 is rotatably supported by the release lever hole 131*d* of the lever nip 131. Moreover, the cam 150*c* of the release lever 150 is placed to contact a contact portion 110*a* provided in the housing 110. Then, a region in contact with the contact portion 110*a* varies in the cam 150*c* along with the rotation of the release lever 150 about the rotating shaft 150*a*.

Specifically, as illustrated in FIG. 5B, in a normal position (see the release lever 150 of a solid line) in which the release lever 150 is placed so that the release lever body 150*b* is along the Z direction, the base circle 150*c*1 of the cam 150*c* is in contact with the contact portion 110*a*. Further, in a raised position (see the release lever 150 of a broken line) in which the release lever body 150*b* is placed so as to be along the X direction and the release lever 150 is placed to be raised, the cam lobe 150*c*2 of the cam 150*c* is in contact with the contact portion 110*a*.

A posture of the release lever 150 is switched between the normal position and the raised position by operating the release lever 150 having such a configuration by a user. Then, as illustrated in FIG. 5B, the position of the rotating shaft 150*a* is varied by switching of the posture of the release lever 150. A posture of the lever nip 131 supporting the rotating shaft 150*a* is changed and a nip pressure in the nip portion is changed along with the switching of the posture.

That is, as illustrated in FIG. 6, in a state where the release lever 150 is disposed in the normal position (see the release lever 150 of the solid line) and the lever nip 131 is placed in a position P1 where the lever nip 131 contacts the fixing roller 101, the pressurizing belt 103 is urged to the fixing roller 101 and a predetermined nip pressure is generated in the nip portion N. In contrast, in a state where the release lever 150 is disposed in the raised position (see the release lever 150 of the broken line) and the lever nip 131 is placed in a position P0 where the lever nip 131 separates from the fixing roller 101 more than the position P1, the fixing roller 101 and the pressurizing belt 103 separate and the nip pressure is not generated in the nip portion N.

Now, when the image is formed on the sheet in the image forming apparatus 1 (see FIG. 1), the release lever 150 is disposed in the normal position and the sheet passing through the nip portion N is pressed with a predetermined nip pressure. On the other hand, for example, when a paper jam (jam) occurs in the fixing device 100, the release lever 150 is raised by an operation of the user and is disposed in the raised position. Therefore, the nip pressure is released in the nip portion N and removing of the sheet is easily performed.

Slide Switch 170

Figure 7A:
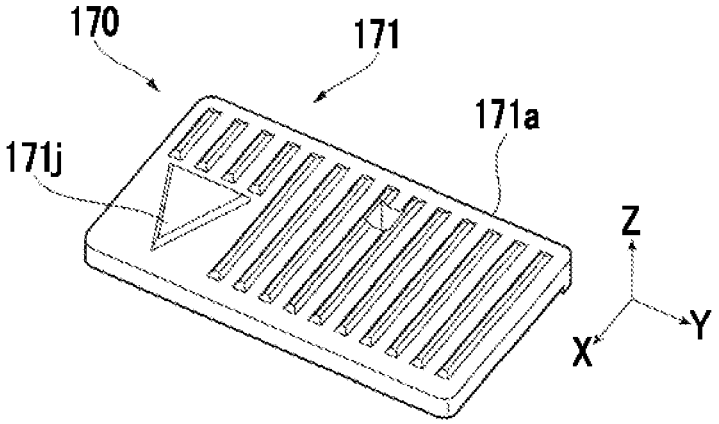
FIG. 7A is a view illustrating a surface of a slide switch body.
Figure 7B:
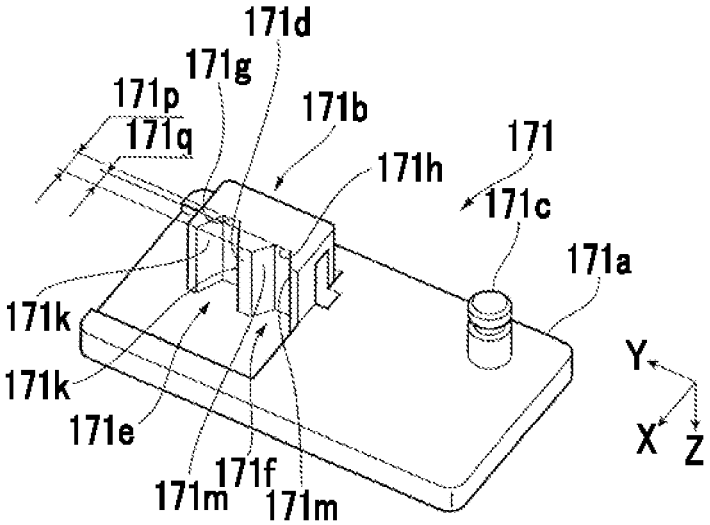
FIG. 7B is a view illustrating a back surface of a slide switch.
Figure 7C:
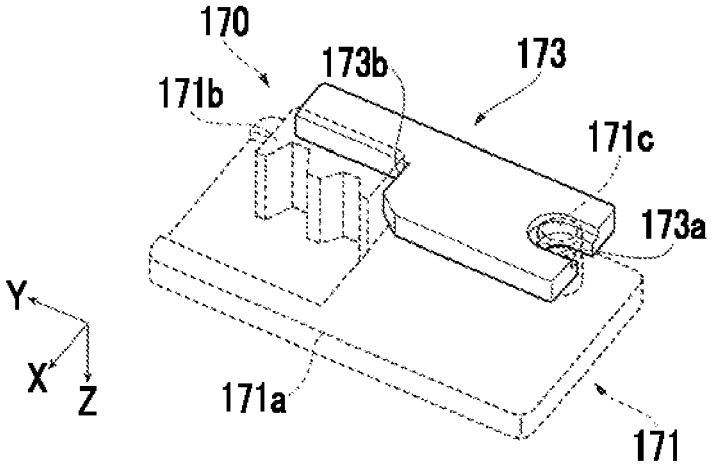
FIG. 7C is a schematic diagram illustrating a catching member and FIG. 7D is a view of the slide switch placed in a housing viewed from the catching member.
Figure 7D:
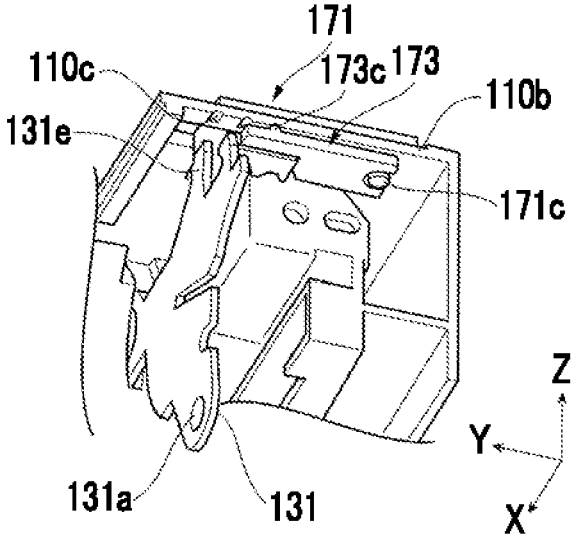

FIG. 7A is a view illustrating a surface of a slide switch body 171, FIG. 7B is a view illustrating a back surface of the slide switch body 171, FIG. 7C is a schematic diagram of a catching member 173 and FIG. 7D is a view illustrating the slide switch 170 placed in the housing 110 viewed from the side of the catching member 173.

Figure 8A:
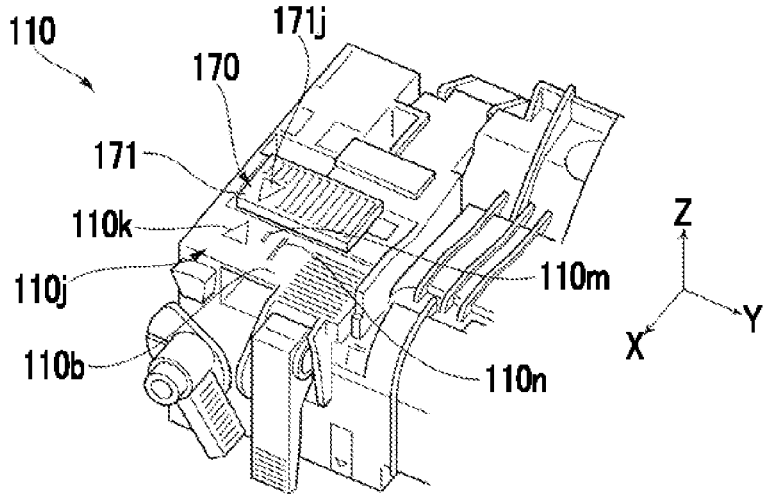
FIG. 8A is a view illustrating the slide switch placed in the housing viewed from the slide switch body and FIGS. 8B and 8C are views illustrating a relative position between the slide switch and a lever nip.
Figure 8B:
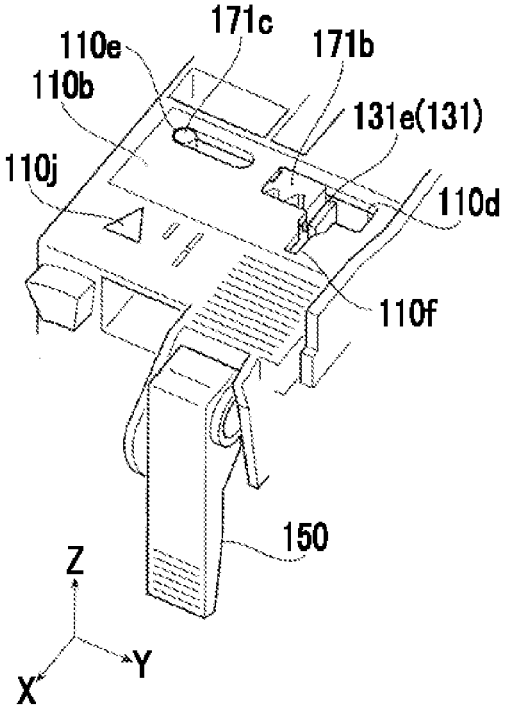
Figure 8C:
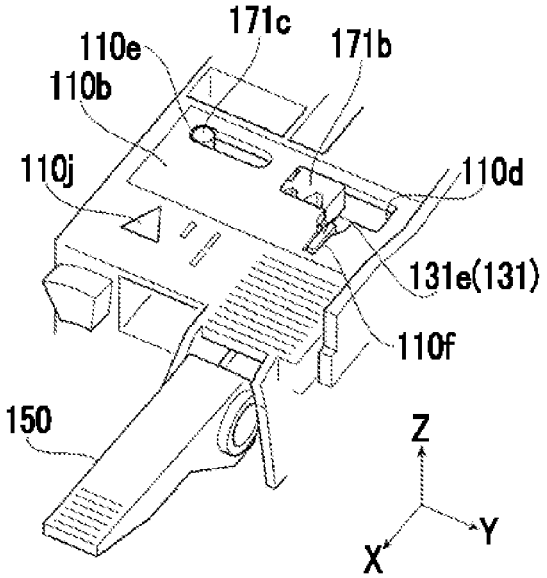

Further, FIG. 8A is a view illustrating the slide switch 170 placed in the housing 110 viewed from the side of the slide switch body 171, and FIGS. 8B and 8C are views illustrating a relative position of the slide switch 170 and the lever nip 131. Moreover, in FIGS. 8B and 8C, a base portion 171*a* of the slide switch body 171 is not illustrated.

Now, in the image forming apparatus 1, for example, when the image formation is performed by using an envelope as a recording material, when the fixing device 100 performs the fixing processing with the same nip pressure as in a case where the image formation is performed on plain paper, creases may occur in the envelope.

Moreover, generally, the envelope is formed by gluing three corners of a two-ply recording material. Then, in the nip portion N, the two-ply recording materials are affected by bent shapes of the fixing roller 101 and the pressurizing belt 103 and are respectively transported at different speeds. It is impossible to escape from deviation of the recording materials from each other caused by the glued portions by the difference in the transport speed, and as a result, the creases may occur.

Thus, in the exemplary embodiment, the fixing device 100 includes the slide switch 170 capable of adjusting the nip pressure in the nip portion N. Then, the nip pressure is adjusted by changing the position of the slide switch 170 and occurrence of creases on the recording material is suppressed.

As illustrated in FIG. 7A, the slide switch 170 that is an example of a pressure adjusting mechanism includes the slide switch body 171 and the catching member 173 (see FIG. 7C) that is fitted and fixed to the slide switch body 171.

As illustrated in FIG. 7A, the slide switch body 171 includes the substantially planar base portion 171*a*. A reference mark 171*j* that is a reference for placing the slide switch body 171 according to the scale mark 110*j* (see FIG. 3A) provided in the switch support portion 110*b* is formed on a surface of the base portion 171*a*.

Further, as illustrated in FIG. 7B, a receiving portion 171*b* that receives the slide switch protrusion 131*e* (see FIG. 4) of the lever nip 131 and a fixing portion 171*c* that fixes the catching member 173 are provided on a back surface of the base portion 171*a*.

The receiving portion 171*b* is a convex portion protruding from the base portion 171*a* toward the −Z direction and is a substantially oblong member in the example illustrated in the view. Further, the fixing portion 171*c* is a convex portion protruding from the base portion 171*a* toward the −Z direction and is a substantially cylindrical shape in the example illustrated in the view.

For further description of the configuration of the receiving portion 171*b*, the receiving portion 171*b* includes a first groove 171*e* and a second groove 171*f* which are respectively recessed from a side surface 171*d* in the side surface 171*d* that is a surface toward the +X direction.

The first groove 171*e* includes a bottom surface (a second receiving portion) 171*g* that is a surface toward the +X direction and an inclined surface (a second inclined surface) 171*k* that is inclined such that a width of the groove in the Y direction becomes narrow advancing in the −X direction.

The second groove 171*f* is formed in a position in the −Y direction from the first groove 171*e*. The second groove 171*f* includes a bottom surface (a first receiving portion) 171*h* that is a surface toward the +X direction and an inclined surface (a first inclined surface) 171*m* that is inclined such that a width of the groove in the Y direction becomes narrow advancing in the −X direction.

Here, when a depth 171*p* (a length from the side surface 171*d* to the bottom surface 171*g* in the X direction) of the first groove 171*e* and a depth 171*q* (a length from the side surface 171*d* to the bottom surface 171*h* in the X direction) of the second groove 171*f* are compared to each other, the depth 171*p* of the first groove 171*e* is greater than the depth 171*q* of the second groove 171*f*. That is, the bottom surface 171*g* of the first groove 171*e* is positioned in the −X direction from the bottom surface 171*h* of the second groove 171*f*.

Here, as illustrated in FIG. 7C, the catching member 173 is a substantially planar member and is provided with a through hole 173*a* into which the fixing portion 171*c* of the slide switch body 171 is fitted and a notch 173*b* that is formed to be along an outer circumferential surface of the receiving portion 171*b*. The catching member 173 is fixed to the slide switch body 171 by fitting the fixing portion 171*c* into the through hole 173*a* and by placing the receiving portion 171*b* in the notch 173*b*.

Next, placement of the slide switch 170 having the configuration described above provided in the housing 110 is described.

First, as illustrated in FIG. 7D, the slide switch 170 is provided by catching the switch support portion 110*b* of the housing 110. For further description, in a state where the slide switch body 171 is placed on the outside (in the side of the +Z direction from the switch support portion 110*b*) of the switch support portion 110*b* and the catching member 173 is placed on the inside (on the side of the −Z direction from the switch support portion 110*b*) of the switch support portion 110*b*, the switch support portion 110*b* and the catching member 173 are provided so as to be fixed to each other.

Moreover, the catching member 173 includes a convex portion (a vibration mechanism) 173*c* protruding toward the switch support portion 110*b* on a surface facing the switch support portion 110*b*. Further, the switch support portion 110*b* includes a recessed portion 110*c* on a surface facing the catching member 173. Plural (three in the example illustrated in the view) recessed portions 110*c* are provided along the Y direction.

When the slide switch 170 is placed in a first position to a third position (described below), each recessed portion 110*c* is formed in a position in which the convex portion 173*c* enters each recessed portion 110*c*. The user moving the slide switch 170 may feel vibration (so-called click feeling) that is generated due to the entrance of the convex portion 173*c* into the recessed portion 110*c* by providing the convex portion 173*c* and the recessed portion 110*c*. The user detects that the slide switch 170 is moved in any one of the first position to the third position by the click feeling. Therefore, positioning of the slide switch 170 is easily performed.

Now, as illustrated in FIG. 8A, the slide switch 170 provided in the housing 110 is placed in a position in which the reference mark 171*j* of the slide switch body 171 faces the scale mark 110*j* of the switch support portion 110*b*.

Further, as illustrated in FIGS. 8B and 8C, the receiving portion 171*b* of the slide switch body 171 enters a state of being inserted into the receiving portion through hole 110*d*. The fixing portion 171*c* of the slide switch body 171 enters a state of being inserted into the fixing portion through hole 110*e*.

Moreover, although not described above, the receiving portion through hole 110*d* is formed with a dimension in which the receiving portion 171*b* is capable of moving on the inside thereof along the Y direction and the fixing portion through hole 110*e* is formed with a dimension in which the fixing portion 171*c* is capable of moving on the inside thereof along the Y direction. Further, the slide switch protrusion 131*e* is inserted into the protrusion through hole 110*f* and the protrusion through hole 110*f* is formed with a dimension in which the slide switch protrusion 131*e* is capable of moving on the inside thereof along the X direction.

Now, the slide switch 170 is switched between a state where the movement thereof is regulated in the Y direction and a state where the movement thereof is allowed in the Y direction on the basis of whether or not the release lever 150 is raised.

That is, as described with reference to FIG. 6, the lever nip 131 is placed in the position P1 when the release lever 150 is disposed in the normal position, and is placed in the position P0 when the release lever 150 is disposed in the raised position. Further, the slide switch protrusion 131*e* of the lever nip 131 placed in the position P1 is also placed in the position in the −X direction more than when placed in the position P0.

Then, as illustrated in FIG. 8B, when the release lever 150 is disposed in the normal position, the slide switch protrusion (regulating mechanism) 131*e* of the lever nip 131 placed in the position P1 is positioned inside the receiving portion through hole 110*d*. In this state, the receiving portion 171*b* is prevented from moving in the Y direction by the slide switch protrusion 131*e* placed inside the receiving portion through hole 110*d*.

Meanwhile, as illustrated in FIG. 8C, when the release lever 150 is disposed in the raised position, the slide switch protrusion 131*e* of the lever nip 131 placed in the position P0 is positioned inside the protrusion through hole 110*f*. Then, in this state, the slide switch protrusion 131*e* placed inside the protrusion through hole 110*f* enters a state of escaping from a moving path of the receiving portion 171*b*. Therefore, the receiving portion 171*b* becomes movable in the Y direction.

Moreover, as illustrated in FIG. 8C, the slide switch protrusion 131*e* of the lever nip 131 placed inside the protrusion through hole 110*f* enters a state where the movement thereof in the Y direction is regulated. That is, the protrusion through hole (fluctuation suppressing mechanism) 110*f* may be considered to be a configuration that reduces the deviation (wobble) of the lever nip 131 in the Y direction.

Further, the slide switch 170 is provided capable of advancing and retracting while moving in a straight line direction with respect to a region in which the lever nip 131 moves along with contact and separation of the pressurizing belt 103 with and from the fixing roller 101, and may be considered as a configuration that adjusts the pressure in the nip portion N which the lever nip 131 contacts inside the region. For further description, the slide switch 170 is movably provided along the rotating shaft 101*d* of the fixing roller 101.

Adjustment of Nip Pressure

Figure 9A:
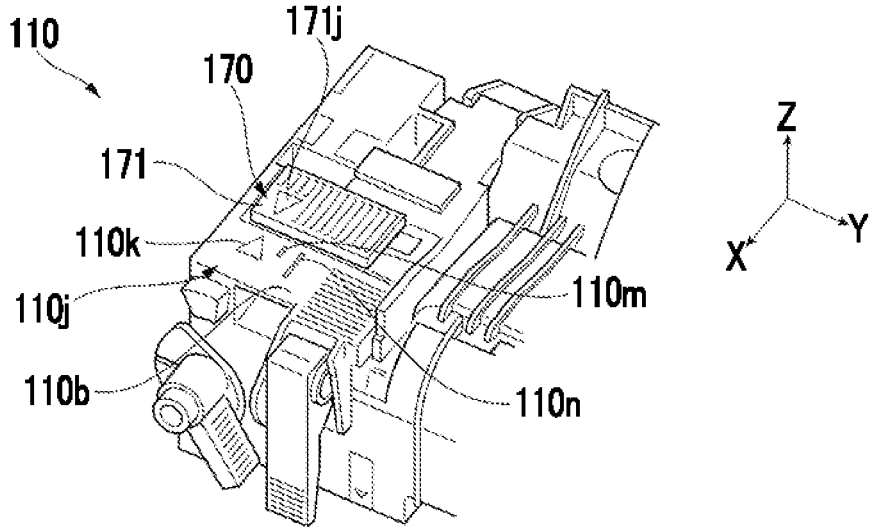
FIGS. 9A to 9C are views illustrating a normal mode.
Figure 9B:
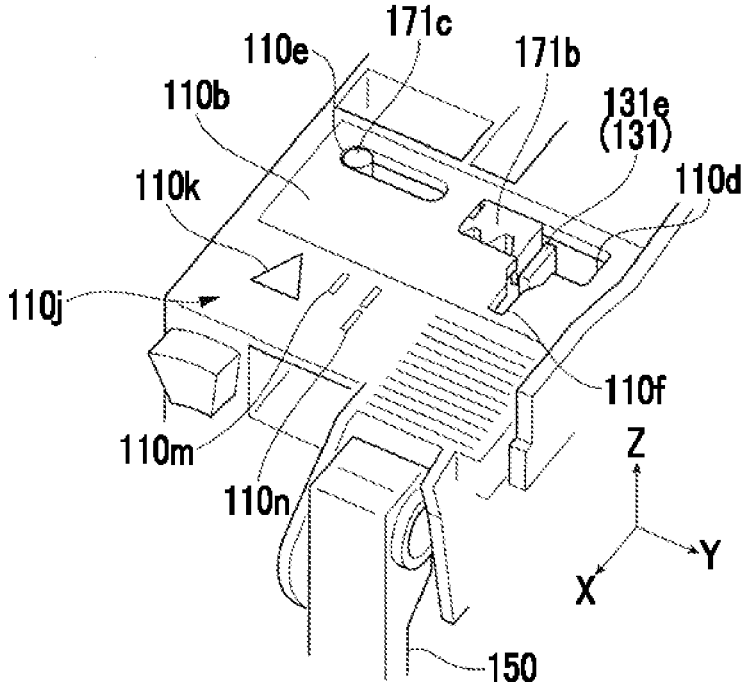
Figure 9C:
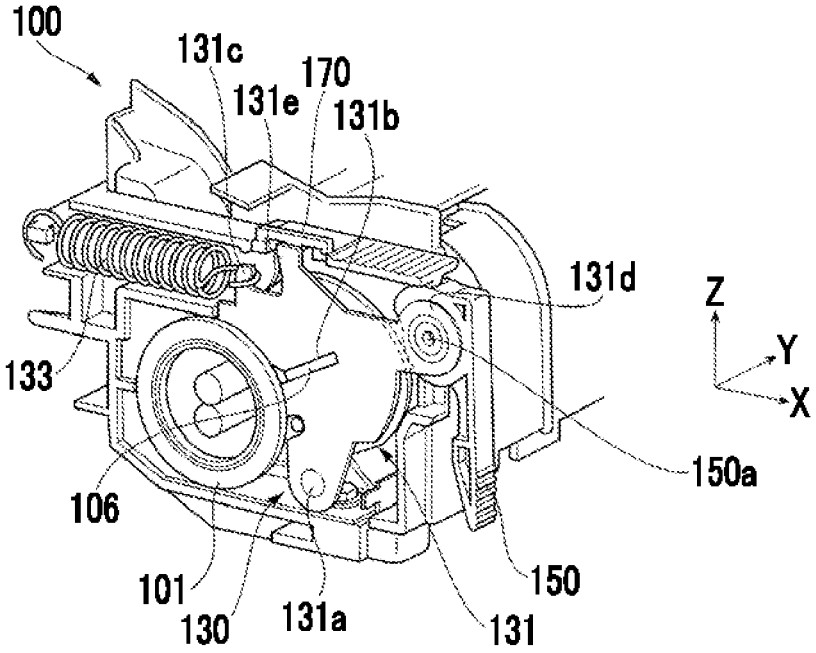
Figure 10A:
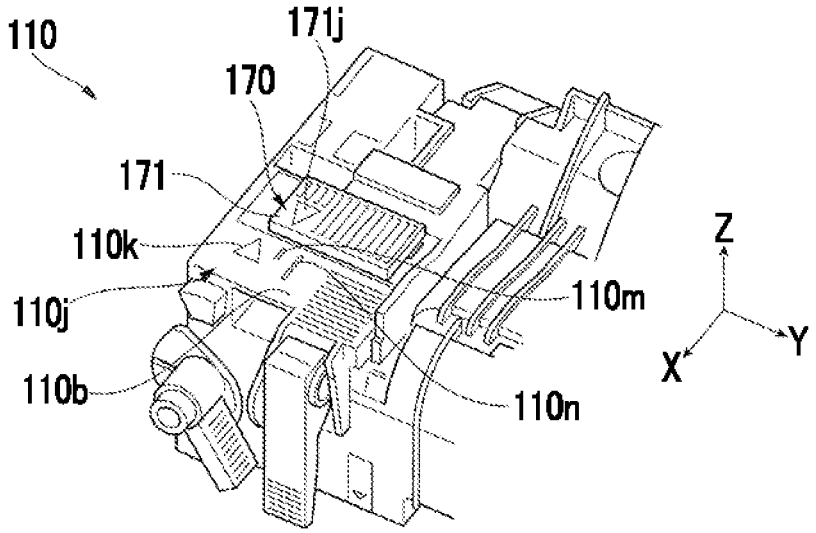
FIGS. 10A to 10C are views illustrating a first envelope mode.
Figure 10B:
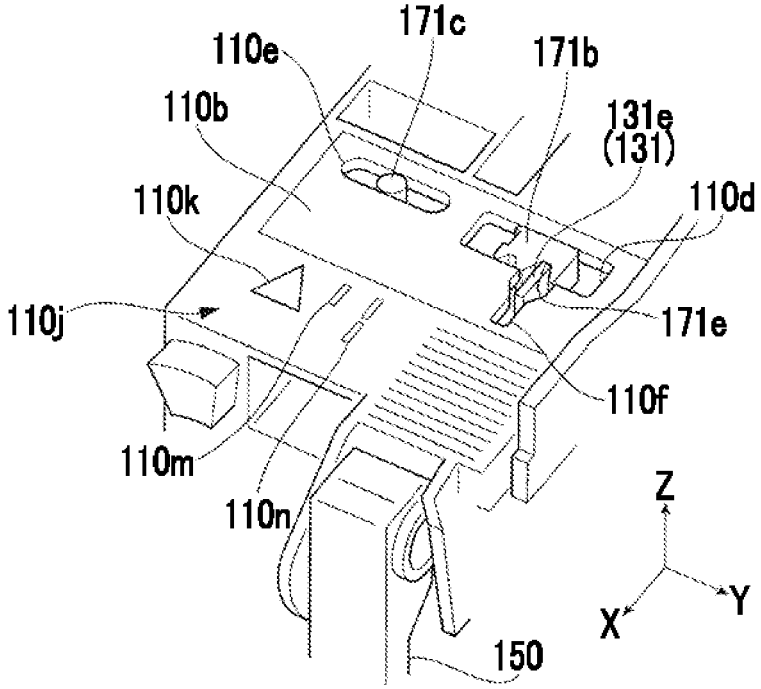
Figure 10C:
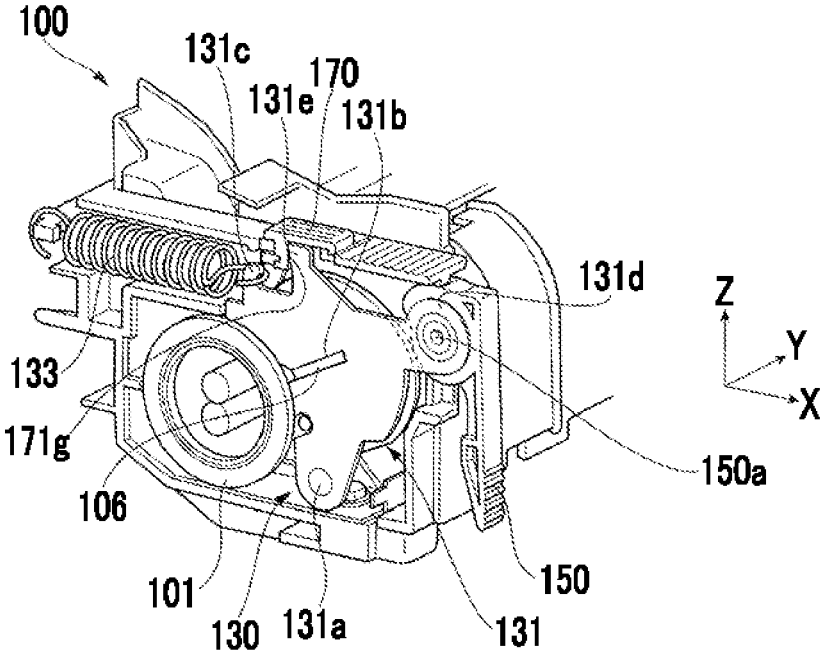
Figure 11A:
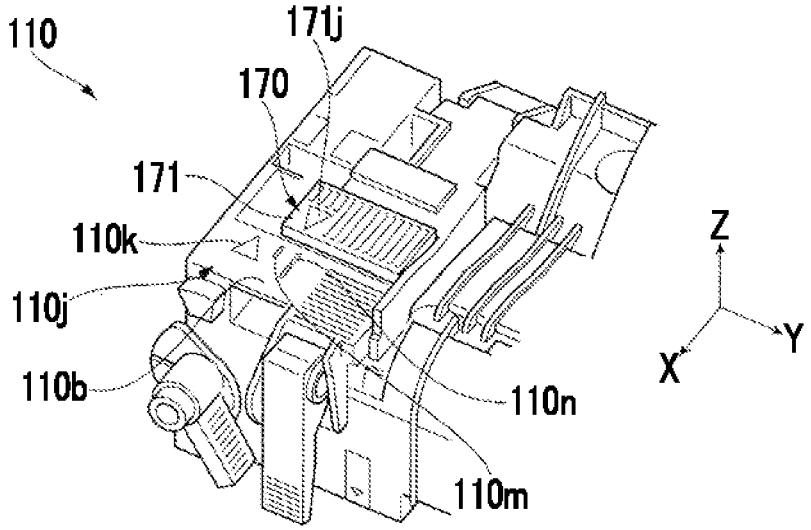
FIGS. 11A to 11C are views illustrating a second envelope mode.
Figure 11B:
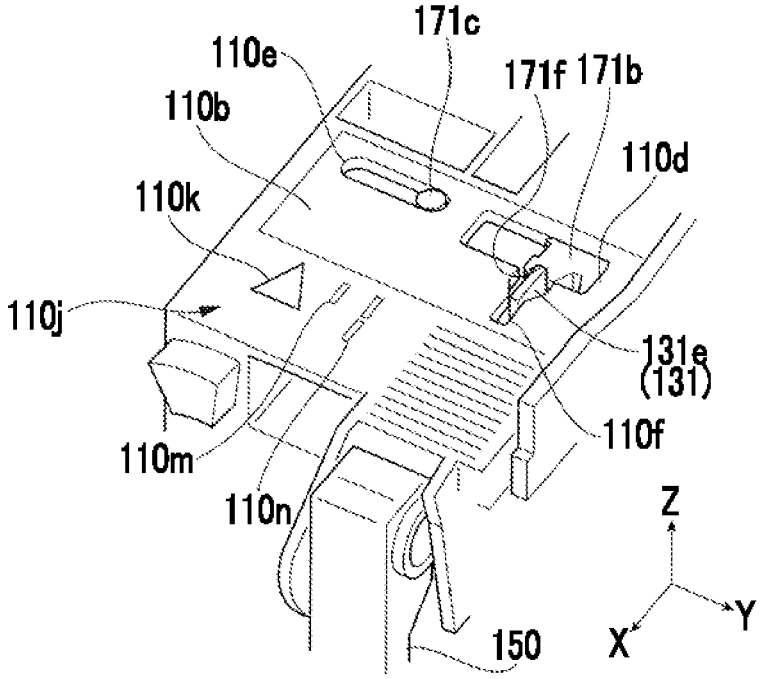
Figure 11C:
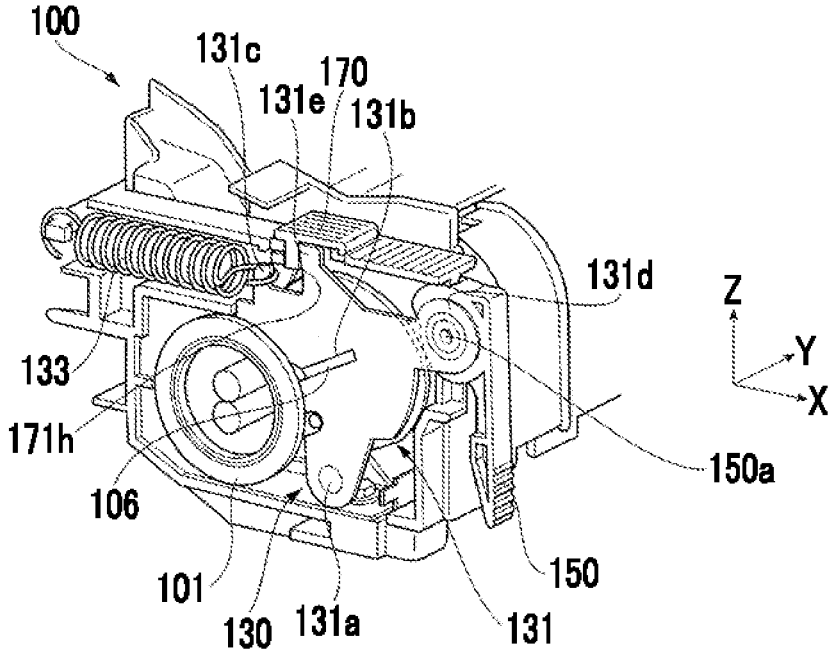

FIGS. 9A to 9C are views illustrating the normal mode, FIGS. 10A to 10C are views illustrating a first envelope mode, and FIGS. 11A to 11C are views illustrating a second envelope mode. For further description, in FIGS. 9A to 11C, FIGS. 9A, 10A and 11A are views illustrating placement of the slide switch 170, FIGS. 9B, 10B and 11B are views illustrating a positional relationship between the receiving portion 171*b* and the slide switch protrusion 131*e*, and FIGS. 9C, 10C and 11C are a views illustrating placement of the lever nip 131. Moreover, in FIGS. 9B, 10B and 11B, the base portion 171*a* of the slide switch body 171 is not drawn.

Now, when the release lever 150 is disposed in the raised position, the slide switch 170 is movable along the Y direction and may be placed in one of the first position, the second position and the third position (described below) which are positioned in this order from the end portion of the housing 110 to the center portion thereof. Moreover, when the release lever 150 is disposed in the raised position, the slide switch 170 is movable so that an operational force that moves the slide switch 170 is reduced and fluctuation of the nip pressure is suppressed when the fixing device 100 performs the fixing processing.

Then, in a state where the slide switch 170 is placed in one position of the first position to third position, when the release lever body 150*b* returns to the normal position, the pressurizing belt 103 is urged against the fixing roller 101 and the nip pressure is generated in the nip portion N. At this time, the nip pressure generated in the nip portion N is changed depending on which one of the first position to the third position the slide switch is placed in.

In the following description, a state where the slide switch 170 is placed in the first position is referred to as the normal mode, a state where the slide switch 170 is placed in the second position is referred to as the first envelope mode and a state where the slide switch 170 is placed in the third position is referred to as the second envelope mode. Then, the nip pressure generated in the nip portion N is reduced in order of the normal mode, the first envelope mode and the second envelope mode.

In the normal mode, as illustrated in FIG. 9A, the slide switch 170 is placed in the first position. Moreover, in the first position, the reference mark 171*j* of the slide switch 170 is positioned in the first scale 110*k* in the scale mark 110*j* of the housing 110.

At this time, as illustrated in FIG. 9B, the receiving portion 171*b* and the slide switch protrusion 131*e* are in a state of not being in contact with each other. Further, as illustrated in FIG. 9C, the lever nip 131 is placed in the position P1.

In the first envelope mode, as illustrated in FIG. 10A, the slide switch 170 is placed in the second position. Moreover, in the second position, the reference mark 171*j* of the slide switch 170 is positioned in the second scale 110*m* in the scale mark 110*j* of the housing 110.

At this time, as illustrated in FIG. 10B, the slide switch protrusion 131*e* is in a state of being placed inside the first groove 171*e* of the receiving portion 171*b*. For further description, the slide switch protrusion 131*e* contacts the bottom surface 171*g* of the first groove 171*e*. The slide switch protrusion 131*e* is positioned in the −X direction from the slide switch protrusion 131*e* of FIG. 9B.

Therefore, as illustrated in FIG. 10C, the lever nip 131 is placed in a position separated from the fixing roller 101 more than the position P1. Therefore, in the first envelope mode, the nip pressure in the nip portion N is reduced more than that in the normal mode.

In the second envelope mode, as illustrated in FIG. 11A, the slide switch 170 is placed in the third position. Moreover, in the third position, the reference mark 171*j* of the slide switch 170 is positioned in the third scale 110*n* in the scale mark 110*j* of the housing 110.

At this time, as illustrated in FIG. 11B, the slide switch protrusion 131*e* is in a state of being placed inside the second groove 171*f* of the receiving portion 171*b*. For further description, the slide switch protrusion 131*e* contacts the bottom surface 171*h* of the second groove 171*f*. The slide switch protrusion 131*e* is positioned in the −X direction from the slide switch protrusion 131*e* of FIG. 10B.

Therefore, as illustrated in FIG. 11C, the lever nip 131 is placed in a position separated from the fixing roller 101 more than the position of FIG. 11C. Therefore, in the second envelope mode, the nip pressure in the nip portion N is reduced more than that in the first envelope mode.

Now, as described above, in a state where the release lever 150 is disposed in the raised position, the release lever 150 returns to the normal position after the slide switch 170 is moved in the Y direction. As a result, the slide switch protrusion 131*e* moves in the −X direction. Then, in a case where the slide switch 170 is placed in the second position or the third position, and the slide switch protrusion 131*e* enters the first groove 171*e* or the second groove 171*f*.

At this time, for example, also in a case where the slide switch 170 is placed in a position that is deviated from the second position or the third position in the Y direction, the slide switch protrusion 131*e* moving in the −X direction contacts the bottom surface 171*g* or the bottom surface 171*h* while moving the slide switch 170 in the Y direction by pressing the inclined surface 171*k* of the first groove 171*e* or the inclined surface 171*m* of the second groove 171*f*. That is, the inclined surface 171*k* of the first groove 171*e* or the inclined surface 171*m* of the second groove 171*f* guides the slide switch protrusion 131*e* to the bottom surface 171*g* or the bottom surface 171*h*.

Further, the positions of the bottom surface 171*g* and the bottom surface 171*h* match each other in the X direction on each surface. Therefore, when the slide switch protrusion 131*e* contacts the bottom surface 171*g* or the bottom surface 171*h*, even when the slide switch 170 is placed to deviate in the Y direction, it is possible to avoid change in the nip pressure in the nip portion N.

Measured Result

Figure 12:
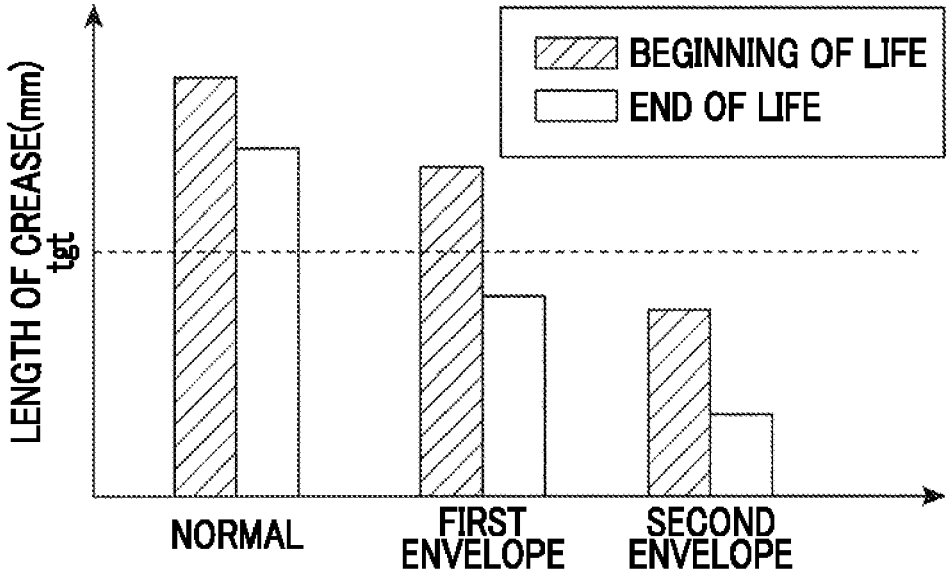
FIG. 12 is a view illustrating a measured result of a length of a crease generated in the normal mode, the first envelope mode and the second envelope mode.

FIG. 12 is a view illustrating a measured result of a length of a crease that occurs in the normal mode, the first envelope mode and the second envelope mode. For further description, a horizontal axis in FIG. 12 illustrates distinction between the normal mode, the first envelope mode and the second envelope mode, and a vertical axis in FIG. 12 illustrates the length of crease that occurs. Further, FIG. 12 illustrates the measured result of the length of crease that occurs at a beginning of life and an end of life of the fixing device 100.

The measured result of the length of crease that occurs when the envelope is respectively used as the recording material in the normal mode, the first envelope mode and the second envelope mode is described.

As illustrated in FIG. 12, it is confirmed that the length of crease that occurs became shortened in order of the normal mode, the first envelope mode and the second envelope mode at both the beginning of life and the end of life of the fixing device 100.

For further description, as described above, the nip pressure of the nip portion N decreases in order of the normal mode, the first envelope mode, and the second envelope mode. Therefore, it is confirmed that the crease that occurs in the recording material is suppressed according to the decrease in the nip pressure of the nip portion N.

Here, when a length of an acceptable crease is referred to as an acceptable crease length tgt, in the normal mode and the first envelope mode at the beginning of life, the crease having a length exceeding the acceptable crease length tgt is observed. Therefore, at the beginning of life, the fixing processing is not performed in the normal mode and the first envelope mode, but is performed in the second envelope mode.

On the other hand, at the end of life, the length of crease exceeded the acceptable crease length tgt only in the normal mode and is less than the acceptable crease length tgt in the first envelope mode and the second envelope mode. Therefore, at the end of life, the first envelope mode or the second envelope mode may be employed. However, in the second envelope mode, transport failure is confirmed by decreasing the nip pressure. Therefore, at the end of life, the fixing processing is not performed in the second envelope mode, but is performed in the first envelope mode.

Additionally, in the fixing device 100 at the end of life, a member formed by the elastic member may be deformed and degraded. For example, when deformation (so-called damage) occurs in the pressing pad 107 that is pressed against the fixing roller 101, the nip pressure in the nip portion N changes (decreases). The exemplary embodiment may be considered as a mode that adjusts the nip pressure in the nip portion N by adjusting the position of the slide switch 170 when the fixing device 100 changes over time. Otherwise, the exemplary embodiment may be considered as a mode that suppresses the transport failure by adjusting the position of the slide switch 170 when the transport failure occurs due to the change over time of the fixing device 100.

Modification Example

Now, in the exemplary embodiment described above, the nip pressure of the nip portion N is adjusted by moving the slide switch 170 in the Y direction. However, the moving direction of the slide switch 170 is not limited to the direction along the Y direction. For example, as illustrated in an arrow K in FIG. 6, a configuration may be applied in which the slide switch 170 is slidingly moved in a direction orthogonal to the Y direction.

Moreover, in the above description, the lever nip 131 is advanced to and retracted from the fixing roller 101 while rotating the vicinity of the rotating shaft 131*a*, but the lever nip 131 (or the pressurizing belt 103) may be advanced to and retracted from the fixing roller 101 while moving in a straight line.

Further, in the above exemplary embodiment, a case where the image is formed on the envelope is described, but, of course, the nip pressure of the nip portion N may be adjusted by using the slide switch 170 when the image is formed on another recording material.

For example, the nip pressure of the nip portion N may be adjusted depending on the thickness of the sheet. Further, the nip pressure may be adjusted depending on curling that occurs in the sheet. Otherwise, the nip pressure may be adjusted depending on paper quality of the sheet such as slipperiness of the sheet or depending on the image such as gloss of the image formed on the sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member configured to fix toner to a recording material while rotating about a rotating shaft;

a pressurizing member configured to form a nip portion through which the recording material passes between the fixing member and the pressurizing member;

a contacting and separating mechanism configured to contact and separate the pressurizing member with and from the fixing member; and a pressure adjusting mechanism that is movable in an axial direction of the rotating shaft, wherein the fixing device is configured to have a first mode in which the pressure adjusting mechanism does not contact the contacting and separating mechanism and a second mode in which the pressure adjusting mechanism does contact the contacting and separating mechanism.

2. The fixing device according to claim 1, further comprising:

a release mechanism configured to release the pressure in the nip portion; and a regulating mechanism configured to allow the pressure adjusting mechanism to move along the axial direction of the rotating in a state where the release mechanism releases the pressure, and configured to regulate movement of the pressure adjusting mechanism along the axial direction of the rotating shaft in a state where the release mechanism does not release the pressure.

3. The fixing device according to claim 2, further comprising:

a fluctuation suppressing mechanism that faces the contacting and separating mechanism and that is configured to prevent a position of the contacting and separating mechanism from fluctuating along with the movement of the pressure adjusting mechanism along the axial direction of the rotating shaft in a state where the release mechanism releases the pressure.

4. The fixing device according to claim 1, wherein the pressure adjusting mechanism includes:

a first receiving portion configured to place the contacting and separating mechanism at a first position by contacting the contacting and separating mechanism; and a second receiving portion configured to place the contacting and separating mechanism at a second position in which a distance between the fixing member and the pressurizing member is shorter than that when the contacting and separating mechanism is placed in the first position by contacting the contacting and separating mechanism at a position different from that of the first receiving portion.

5. The fixing device according to claim 4, wherein the pressure adjusting mechanism has a first inclined surface that is an inclined surface for guiding the contacting and separating mechanism to the first receiving portion, and a second inclined surface that is an inclined surface for guiding the contacting and separating mechanism to the second receiving portion.

6. The fixing device according to claim 4, wherein the pressure adjusting mechanism includes:

a vibration mechanism configured to generate vibration when the pressure adjusting mechanism moves along the rotating shaft of the fixing member and the pressure adjusting mechanism is placed at a position in which the contacting and separating mechanism contacts the first receiving portion or the second receiving portion.

7. An image forming apparatus comprising:

an image forming portion configured to form a toner image on a recording material;

a fixing member configured to fix the toner image formed by the image forming portion to the recording material while rotating about a rotating shaft;

a pressurizing member configured to form a nip portion, through which the recording material passes, between the fixing member and the pressurizing member;

a release mechanism configured to release a pressure in the nip portion;

a contacting and separating mechanism configured to contact and separate the pressurizing member with and from the fixing member; and a pressure adjusting mechanism that is movable in an axial direction of the rotating shaft, wherein the image forming device is configured to have a first mode in which the pressure adjusting mechanism does not contact the contacting and separating mechanism and a second mode in which the pressure adjusting mechanism does contact the contacting and separating mechanism.

8. The fixing device according to claim 1, wherein the pressure adjusting mechanism comprises a slide switch.

9. The fixing device according to claim 1, wherein all of the pressure adjusting mechanism is provided outside an outermost periphery of the pressurizing member.

* * * * *